United States Patent [19]

Buzzi

[11] 3,945,173

[45] Mar. 23, 1976

[54] MACHINE FOR AUTOMATICALLY FILLING AND SEALING BAGS

[76] Inventor: Riccardo Buzzi, Via 5 Maggio No. 19, Milan, Italy

[22] Filed: Sept. 18, 1974

[21] Appl. No.: 507,200

[30] Foreign Application Priority Data

Oct. 5, 1973 Italy ..... 29792/73

[52] U.S. Cl. ..... 53/188; 53/371; 53/386

[51] Int. Cl.[2]B65B 43/30; B65B 43/34; B65B 43/46; B65B 43/60

[58] Field of Search ..... 53/188, 190, 371, 384, 53/373, 386, 187

[56] References Cited

UNITED STATES PATENTS

| | | | |
|---|---|---|---|
| 2,864,219 | 12/1958 | Knisely | 53/386 X |
| 3,112,777 | 12/1963 | Lohse | 53/187 X |
| 3,190,049 | 6/1965 | Van Der Meulen | 53/187 X |
| 3,398,503 | 8/1968 | Bertoglio | 53/187 |
| 3,566,578 | 3/1971 | Thorne et al. | 53/190 X |

*Primary Examiner*—Travis S. McGehee
*Assistant Examiner*—Horace M. Culver
*Attorney, Agent, or Firm*—Kirschstein, Kirschstein, Ottinger & Frank

[57] ABSTRACT

A ··chine for automatically filling and sealing bags. Bags are placed in flat condition on a stack. Suckers pick up the uppermost bag from the stack and move it to a platform which has a substantial horizontal component and on which the bag is placed in a predetermined position. Thereupon, grippers engage the opposite sides of the bag near the bag mouth. Next, spreaders swing into the bag mouth to open the same and hold the same open. The spreaders and grippers are mounted to turn about a horizontal axis and they swing the bag held by the grippers with its mouth maintained open by the spreaders through an arc to a position in which the bag is upright and located beneath the spout of a batching machine. The bag then is filled while it is held by the grippers. The grippers also are mounted to turn about a vertical axis and do so turn after the bag is filled, carrying the bag with them through an arc in a horizontal plane. The path of movement of the bag about the vertical axis causes the mouth of the bag to move into operative engagement with a closing device such as a sewing machine, taping machine or sealing machine. After filling but prior to closure, the grippers together with the filled bag are moved first up and then down through a short stroke to eliminate air in the bag above the material with which the bag just has been filled. The filled and closed bag is rested on a supporting plate from which, after the elimination of air from the bag and the closing of the bag, the bag is slid by tilting of the plate onto a delivery conveyor.

11 Claims, 3 Drawing Figures

MACHINE FOR AUTOMATICALLY FILLING AND SEALING BAGS

The present invention relates to an automatic machine for filling bags with a predetermined quantity of material and then sewing the bag which thereafter is deposited on a conveyor belt or similar device.

It is well known that powdered or granular materials, for example, foodstuffs, fodder, salts, fertilizers, chemical substances and others are generally packed in bags made of paper, jute or various synthetic materials. The bags are manually fitted to the lower end of a batching device and, after filling, sewn up by a suitable portable machine and/or sealed with adhesive tape, the latter when bagging moisture-sensitive substances.

The hand-operated filling and sewing of the bags requires a certain amount of labour has a considerable influence on the manufacturing costs. In addition, hand-operated filling and sewing does not allow full exploitation of the output capacity of modern batching and filling devices.

A machine which can automatically fill bags is already known. This filling machine, besides being rather costly and bulky, does not allow the removal of air trapped in the bag at the end of the filling step, so that same labour is still required to remove this air. This is particularly important when dealing with products which are deleteriously affected by oxygen and moisture in the air. The said known machine is also difficult to adapt to bags of varying length. In addition, further manpower is required to shift the filled bags to a transporting means and to position each bag for sewing.

Further, other stationary machines are known which make it possible to sew filled bags progressively fed by a conveyor belt. The main drawback of these known sewing machines is that the filled bags must be arranged in the right position on the conveyor belt to make sure that the machine sews the bags. Another drawback of these stationary machines is their high cost, the impossibility of removing the air remained in the bags, the difficulty of adapting the machine to process bags of various lengths and that they operate only with the bags perfectly aligned on the conveyor belt. This alignment of the bags on the belt is often rather difficult, particularly when dealing with granular or amorphous filling material.

Other known sewing machines have been designed to eliminate the above-mentioned drawbacks by using bags which are much longer than required, so that they can be sewn far below the upper end of the bag to compensate for irregular alignment of the bags on the belt. This method, however, requires the use of bags longer than necessary and, at the end of the sewing step, trimming of the upper end of the bag, with a considerable waste of bag material.

It is an object of the present invention to provide a simple and sturdy machine of the character described which makes it possible to automatically fill a bag, eliminate the air trapped in the filled bag and sew up the latter, ensuring at all times that the bag, from the beginning of the cycle, that is, from the moment the empty bag is taken up from the stock pile, to and through the moment the filled and sewn bag is delivered to the conveyor belt, is always firmly kept by suitable positioning means which ensure that the filled bag is sewn and sealed where required at a predetermined level.

A further object of the present invention is to provide a machine which can handle bags of various lengths without requiring adjustments or adaptation of the same to bags of different lengths.

Said objects are satisfied by the machine designed according to the present invention which machine is fitted with arms, that oscillate around a horizontal axis and are provided with grippers to grasp on both sides a horizontally disposed bag to be filled and to vertically position it below a batching device, and where the said arms are at the same time so designed that they can oscillate around a vertical axis for moving the filled bag in upright position along an arc of a circle, the said machine being coupled to a closure means such as a sewing machine and/or adhesive tape fitting device and/or sealing device, the said closure means being oscillatable around the said vertical axis to permit the bag to be closed while moving along the arc of the circle.

It is an essential advantage of the machine according to the present invention that, from the moment the bag in horizontal position has been gripped by the oscillating arms at the opposite sides of its mouth until its delivery to a conveyor the said bag is always perfectly guided and kept in upright position during filling and closing.

Further characteristics thereof can be taken from the following description, claims and accompanying drawings.

The machine according to the present invention will now be described in detail by way of a preferred embodiment thereof given by way of example without being limited thereto and as illustrated in the accompanying drawings, in which.

Figure 1:
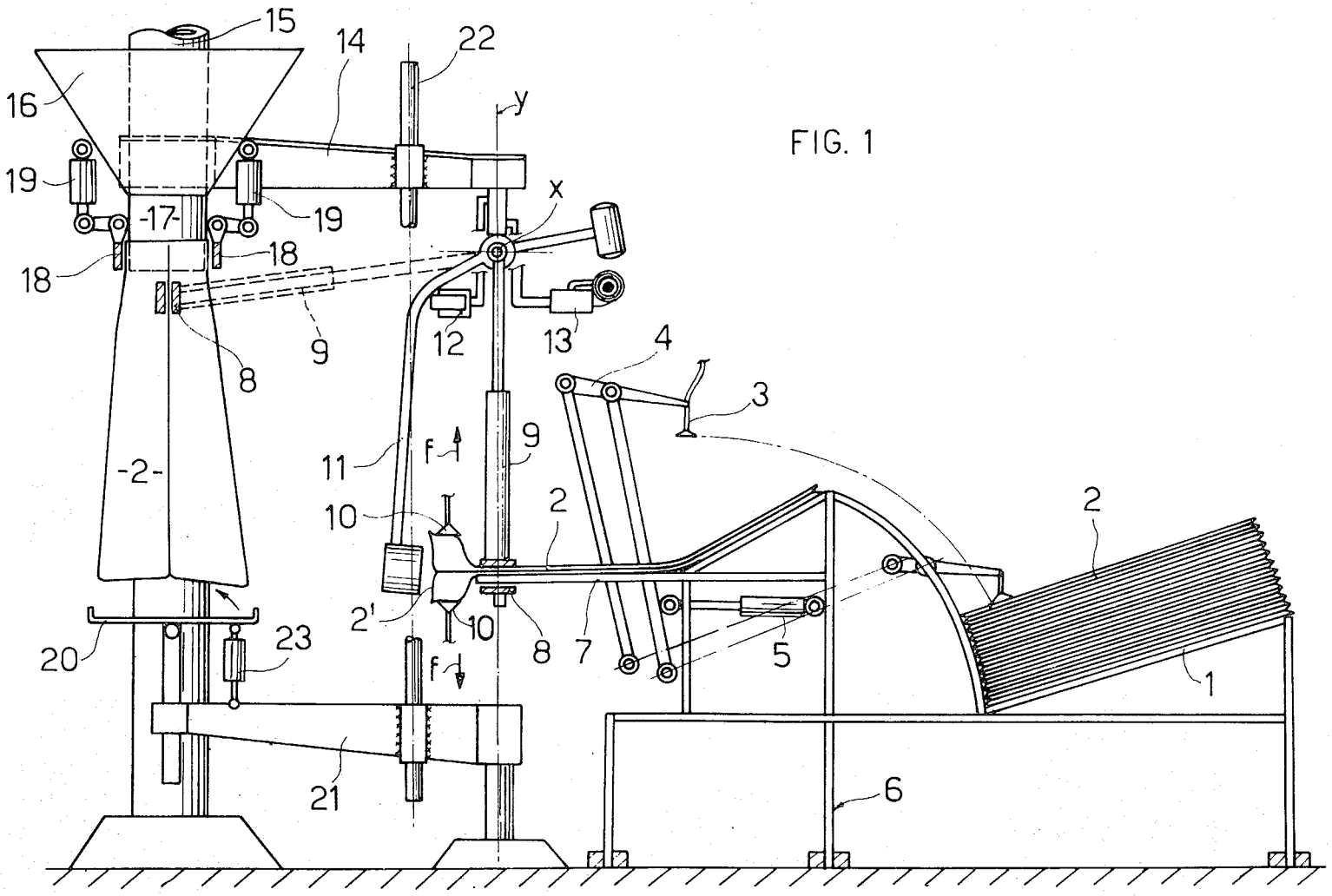
FIG. 1 is an elevation of a machine according to the present invention.

As shown in FIG. 1, the machine comprises a table 1 which carries a stock pile of bags 2 to be filled. With the help of a feeding sucker 3 driven by a coupling 4 controlled for example by a hydraulic piston 5 fixed to the frame 6 carrying the table 1, the bags 2 taken up from the pile are positioned on a second table 7, preferably inclined to the front, to ensure that the bag 2, when released from the sucker 3, automatically slides in a predetermined position on the table 7 in which the mouth 2' of the bag is forward and the flat bag has a substantial horizontal component. In this position the bag 2 is now between the open grippers 8 of two retracted arms 9 arranged on the two longitudinal sides of the table 7 near the mouths of the bags. The arms 9 are mounted to oscillate both around a horizontal axis $x$ and around a vertical axis $y$, as will be explained in more detail hereinbelow. The automatic opening of the mouth' of the bag 2 on the table 7 is effected by two suckers 10 which are mobile and so designed that they can open the bag mouth in the direction of the arrow $f$ to ensure the introduction of spreaders 11 consisting of retractable arms so arrenged that they, too, can oscillate around the horizontal axis $x$. The machine according to the present invention is in addition fitted with a sewing device 12 (FIGS. 2 and 3) and a device 13 for applying an adhesive tape and/or a device (not shown) for sealing bags made of a synthetic material. The said devices 12 and 13 are carried by horizontal arms mounted to oscillate around the axis *y*. The grippers 8, arms 9, the spreaders 11 and the arms carrying the sewing device 12 and the adhesive tape device 13, are all carried by a sturdy cantilever arm 14 fitted to a vertical column 15 (FIGS 1 and 2) which also carries the hopper 16 of a batching device (not shown in detail). The bag 2 to be filled can be fitted around the outlet end 17 of the hopper 16 by pressure pads 18 controlled, for example, by small pneumatic pistons 19. Below the bag 2, fixed to the outlet 17, there is a supporting and carrying plate 20 which can be adjusted in height. The said plate 20 is carried by a cantilever arm 21 which can oscillate in such a manner that its vertical axis of rotation coincides with the vertical axis *y*. To ensure that the motion around axis *y* of the gripper arms 8, 9 is synchronized with that of the supporting plate 20 carrying the full bag, the cantilever arom 21 of the plate 20 and the elements controlling the arms 8, 9 in the horizontal plane are rigidly interconnected by a vertical rod 22 which, to prevent any obstruction of the central space of the machine, is spaced from the arms 21 and 14, laterally, that is in the plane perpendicular to the drawing FIG. 1.

Figure 3:
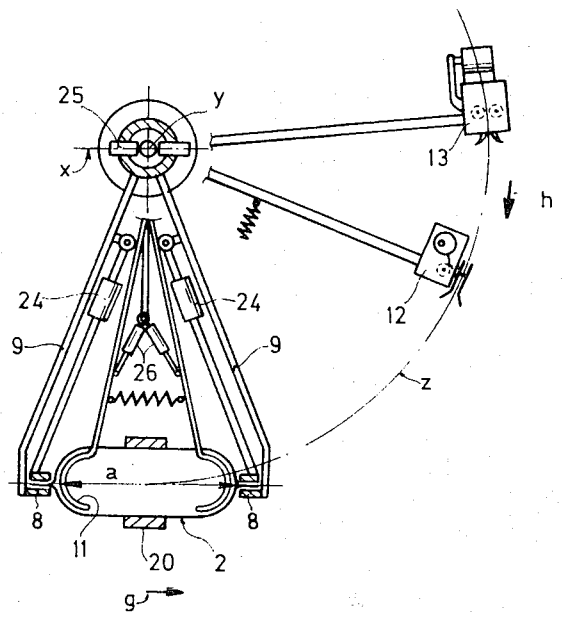
FIG. 3 is a plan view of a detail of the said machine showing the grippers, the spreaders and the bag mouth closing means.
Figure 2:
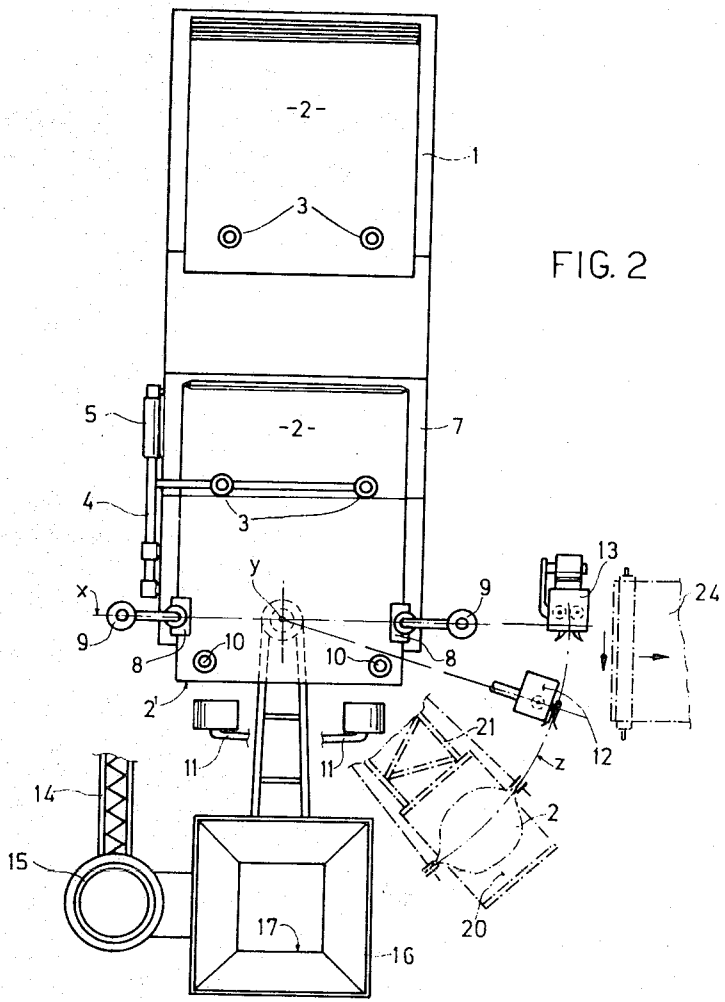
FIG. 2 is a plan view of the machine.

The supporting plate 20 can be connected to a small piston 23 to permit tipping over of the bag, after sewing, onto a conveyor 24 schematically shown in FIG. 2. As shown in FIG. 3, the arms 9 with the grippers are for example driven by small pneumatic pistons 24 or similar elements, can oscillate around the axis *x*, for example, around the pivot 25. The spreaders 11 also are mounted to oscillate about the same axis *x*, being driven, for example, by small pistons 26. The arms 9 and spreaders 11 are so made that they can approach one another or separate in an elastic manner to compensate for differences in the width *a* of the bag 2. The gripper arms 9 do not only oscillate around the axis *x*, but also can move, together with the bag 2 and the supporting plate 20, around the vertical axis *y*, so that the bag is swingable along an arc of a circle *z*. Around the vertical axis *y*, along the arc *z*, a sewing device 12 and/or a further device 13 are swingable for the application of an adhesive tape to the upper edge of the bag 2, which previously has been sewn. It also is possible to provide in addition to the sewing device, a sealing device for bags made of thermoplastic material or lined on the inside with a synthetic material. During the time that the bag 2, held by the grippers 8 of the arms 9, is moved together with the plate 20 in the direction of the arrow *g*, the sewing and closing devices 12, 13 are moved in the direction of the arrow *h*. Both the sewing device 12 and the adhesive tape device 13 are provided with proper driving means and, as soon as the front edge of the bag 2 is gripped by the feed rollers or similar means of devices 12 and 13, the latter are automatically moved along the upper edge of the bag 2. This arrangement is particular advantageous and permits compensation for feed irregularities of the bag 2; further, the two feed motions being in opposite directions, the mouth closing step is carried out in minimum time.

The operation of the machine according to the present process is as follows:

The sucker 3 removes a bag 2 from the stock pile on table 1 and places it onto the inclined table 7 with the bag now automatically sliding into a determined position with stopping means, so that the front of the bag is horizontal and the side edges thereof are between the open grippers 8 of the arms 9. As soon as the bag lies between the grippers 8, the latter are closed to lock the bag approximately in the position shown in FIG. 1. At both sides of the mouth 2' of the bag there are provided moveable suckers 10 which, after the locking of the bag between the grippers 8, open the bag mouth in the directions of the arrows *f* for the insertion of the spreaders 11. Then the arms 9 and spreaders 11 turn around the horizontal axis *x* and carry the bag below the hopper 16 where the pressure pads lock the bag 2 firmly to the oulet tube 17. The bag is now filled with a quantity of material established by the batching machine. At the end of the filling phase, the bag is lowered onto the supporting plate 20 together with the arms 9, to grippers 8 continuing to hold the bag in upright position, while the spreaders 11 rest in horizontal position at the height of the pressure pads 18.

To remove the air caught in the bag, the arms 9 make a short downstroke and eliminate the air contained in the bag, then return again into the position to keep the bag perfectly tight and upright. At this point, with the help of suitable driving means, the bag 2 is moved, together with the supporting plate 20 and the locking arms 9, around the vertical axis *y* in the direction of the arrow *g* along an arc of circle *z* to meet the sewing device 12 and/or adhesive tape applying device 13 thereafter, when it is required to seal the sewn-up opening (FIG. 3).

After sewing up and sealing, the bag 2 is approximately at the height of the conveyor 24. In this position, the grippers 8 release the bag which, after inclination of the supporting plate 20 by means of the piston 23, is now deposited onto the conveyor. At this point all the movable components of the machine return to their original position for the next cycle.

It is advantageous to effect all the motions by pneumatic and/or hydraulic pistons controlled by respective valves. However, the said driving elements and their controls, being generally known, their illustration and description has been omitted for the sake of greater clarity.

What I claim is:

1. A machine for automatically filling and sealing bags, said machine comprising:

A. means for supporting a bag in closed condition with its mouth substantially horizontal, B. gripping means for gripping the bag on both sides thereof near the mouth, C. means mounting said gripping means for swinging movement about a horizontal axis, D. further means mounting said gripping means for swinging movement about a vertical axis, E. a batching device having a discharge, F. means actuating said first-named swinging means to locate said gripping means adjacent both sides of said bag near the mouth thereof, G. means further actuating said gripping means to cause said gripping means to engage said bag at both sides thereof adjacent the mouth, H. spreading means to open the mouth of the bag gripped by said gripping means, I. means to further actuate the gripping means to swing the same about the horizontal axis with its mouth open and to place the open mouth below the discharge of the batching device with the bag in vertical position, open mouth uppermost, J. said batching device being energizeable to fill the bag beneath the discharge thereof, K. a transporting means, L. a bag closure means, M. means further actuating the gripping means to move the filled bag about a vertical axis from beneath the batching means into operative engagement with the closure means and then onto the transporting means, N. means to actuate the closure means as the bag enters into operative engagement therewith, and O. means to open the gripping means when the bag reaches the transporting means so as to discharge the filled and closed bag onto the same.

2. A machine as set forth in claim 1 which further includes a stack of closed bags and means to remove bags from the stack one at a time to the single bag supporting means.

3. A machine as set forth in claim 2 wherein the means to move the bags from the stack includes suckers.

4. A machine as set forth in claim 1 in which a table is provided to support the bag, said table supporting the bag with its bottom in inclined position and its mouth in horizontal position.

5. A machine as set forth in claim 1 in which there further is included means for opening the mouth of the bag to facilitate operation of the spreading means.

6. A machine as set forth in claim 1 in which the horizontal and vertical axes of swinging movement of the gripping means intersect.

7. A machine as set forth in claim 1 in which means is included to support the closure means for movement about the vertical axis.

8. A machine as set forth in claim 7 in which means is included to move the closure means toward the batching means during operative engagement of the closure means and the filled bag.

9. A machine as set forth in claim 1 in which there further is provided a supporting plate located beneath the bag during filling, said plate being mounted for movement about the vertical axis.

10. A machine as set forth in claim 9 in which means is included to raise and lower the supporting plate, the supporting plate being lowered after filling the bag to eliminate air present in the bag above the filling material and then being raised to return the bag to its original position beneath the discharge.

11. A machine as set forth in claim 9 in which the supporting plate is horizontal during the filling of the bag and in which means further is included to tilt the supporting plate as the supporting plate and filled bag reach the transporting means so as to facilitate transfer of the filled and closed bag to the transporting means.

* * * * *